US005479660A

United States Patent [19]

Najac

[11] Patent Number: 5,479,660

[45] Date of Patent: Jan. 2, 1996

[54] EXERCISE GLOVE

[76] Inventor: Gregory Najac, 229 Rte. 202, Pomona, N.Y. 10970

[21] Appl. No.: 227,396

[22] Filed: Apr. 14, 1994

[51] Int. Cl.[6] ..... A41D 13/08

[52] U.S. Cl. ..... 2/20; 2/161.1

[58] Field of Search ..... 2/16, 20, 159, 2/161.1, 161.3, 161.8, 161.6, 161.5; 273/26 C, 166; 482/44, 49, 139; 602/21, 61, 62

[56] References Cited

U.S. PATENT DOCUMENTS

| | | | |
|---|---|---|---|
| 1,887,278 | 2/1931 | Auster . | |
| 2,309,710 | 2/1943 | Patterson, Jr. | 2/161.3 |
| 2,867,814 | 1/1959 | Miles, Jr. | 2/20 |
| 2,929,372 | 3/1960 | Vance | 2/161.5 |
| 3,501,773 | 3/1970 | Stansberry et al. | 2/159 |
| 3,971,374 | 7/1976 | Wagner | 602/62 |
| 4,183,100 | 1/1980 | De Marco . | |
| 4,546,495 | 10/1985 | Castillo . | |
| 4,558,694 | 12/1985 | Barber | 602/21 |
| 4,589,146 | 5/1986 | Taylor | 2/161.3 |
| 4,754,499 | 7/1988 | Pirie . | |
| 4,793,005 | 12/1988 | Hetzel . | |
| 4,977,621 | 12/1990 | Richard | 2/161.3 |
| 5,081,715 | 1/1992 | Mascia | 2/20 |
| 5,217,029 | 6/1993 | Shields | 602/62 |
| 5,350,343 | 9/1994 | DaSilva | 2/20 X |
| 5,353,440 | 10/1994 | Meldeau | 2/161.1 |

FOREIGN PATENT DOCUMENTS

| | | | |
|---|---|---|---|
| 9400030 | 1/1944 | WIPO | 2/159 |

*Primary Examiner*—Michael A. Neas
*Attorney, Agent, or Firm*—Stanley J. Yavner

[57] ABSTRACT

An exercise glove includes a generally rectangular palm structure with one end being slightly curved and the other end having a generally straight edge for fitting comfortably under the middle joint of the fingers. A pair of straps with hook and loop connectors extend outwardly from the sides near the curved end to encircle the back of the hand. The item is used primarily by weight lifters, but also in other forms of exercise. The surface of the generally planar palm structure, which faces outwardly from the palm, includes a stipled coating for providing an improved grip. Also, the inwardly facing surface includes a padding or cushion for assisting in cushioning shock during exercise.

4 Claims, 1 Drawing Sheet

EXERCISE GLOVE

FIELD OF THE INVENTION

This invention relates primarily to exercise gloves and more particularly to such gloves for protecting the palm of the hand, for aiding the gripping of exercise devices and for convenient and efficient use.

BACKGROUND OF THE INVENTION

The present day emphasis on exercising has risen to the point where exercising conveniences and implements are also rising in expense to the consumers of such products. Also, elevating is the necessity for simplifying the design of exercise products and conveniences in order to bring down the cost and increase the efficiency of their use.

Indeed, one of the primary requisites for exercise devices is that they perform their intended functions without the expenditure of a great deal of time in preparing for use of such devices, and yet they must adequately performed their intended function.

In the are of exercise gloves for use in weight lifting, chinning and other exercise, various glove structures have been provided, but a great many on the market are cumbersome to wear, do not adequately perform their intended function and require a great deal of time to place on the user's hand and to fix in place. An example of designs on the market today are typical baseball gloves for assisting in gripping the baseball bat. Such gloves usually offer convenient fasteners, but are structured with full fingers and back of the hand and palm covers, most of which structure is unnecessary for their intended function. For instance, gripping a baseball bat involves substantially all of the palm, the lower part of the fingers and none of the other parts of the hand or finger structure of the user. The extra fabric used in such gloves, unnecessary for the contact parts of the hand with the bat, merely served to make the baseball glove more cumbersome than it need be, in terms of placing on the user's hand and cushioning the palm for swinging the bat. The same is true with respect to weight-lifting gloves and the like.

An example of present-day structures for exercise gloves is disclosed in the following U.S. Pat. Nos.: De Marco 4,183,100, Auster 1,887,278, Hetzel 4,793,005, Castillo 4,546,495 and Pirie 4,754,499.

De Marco, Hetzel and Castillo adequately perform their function, but with the use of full finger holes for the user, which make the glove more difficult than it need be when placing it on the user's hand in order to perform the function of protecting the lower part of the fingers near the palm and the palm area itself. Auster and Pirie use loops for the fingers and thereby suffer from the same disadvantage of excess material and structure for the intended purpose.

OBJECTS AND SUMMARY OF THE INVENTION

Accordingly, a primary object of the present invention is to provide a protective exercise glove for the palm area of the user, which is efficient in its structure toward performance of its intended function.

A further and more particular object is to provide such an exercise glove which is easy to place on the user's hand, easy to fasten and yet efficient and adequate to perform the intended protective function.

These and other objects of the present invention are provided in the structure of an exercise glove which features a protective, planar, generally rectangular palm structure, one end of which is slightly curved to accommodate the upper part of the palm of the user, and the other end of which is generally straight in order to accommodate the underside of the fingers at the point of the middle joints thereof. Straps with VELCRO hook and loop fasteners extend outwardly of the sides of the palm structure, near the curved edge, in order to fix the item by encircling the back of the hand of the user. A stippled surface is defined by the outwardly facing surface of the palm structure and a cushion is affixed on or in the palm-facing surface thereof.

BRIEF DESCRIPTION OF THE DRAWINGS

Other objects, features and advantages of the present invention will become apparent by reference to the following detailed description of the preferred, but nonetheless illustrative, embodiment, with reference, in turn, to the following drawings.

DETAILED DESCRIPTION

Figure 1:
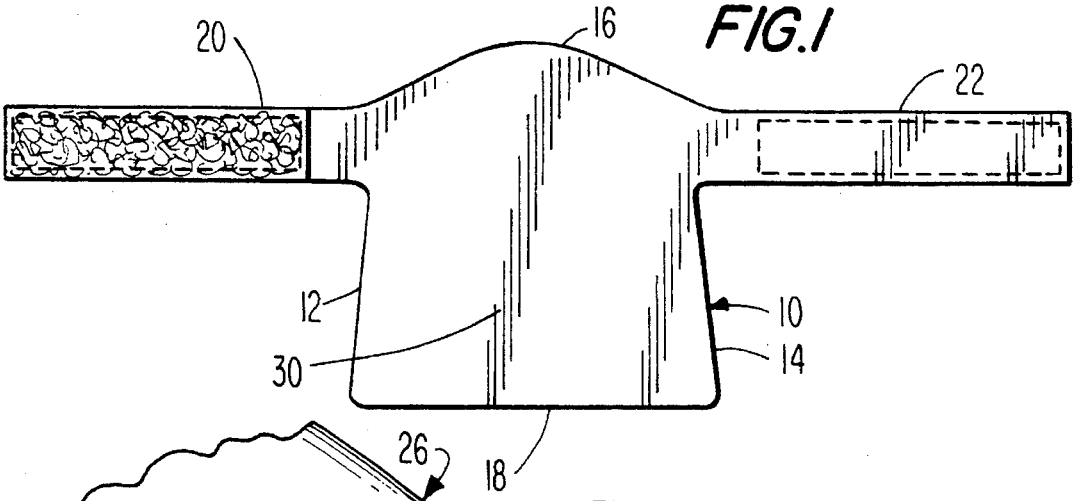
FIG. 1 is a top plan view of the exercise glove of the present invention, showing particularly the curved end for conforming to the top of the palm and the straight end for nestling under the middle joints of the fingers.

Referring to the drawings, an exercise glove according to the present invention is shown as including a palm structure generally designated 10. Palm structure 10 is generally in the form of a rectangle, defining sides 12, 14, curved end 16 and straight end 18. Outwardly extending from palm structure 10, near curved end 16, are two straps 20, 22, shown in FIGS. 1 and 4 as including the two parts of a VELCRO fastener, respectively. In such an embodiment of the present invention, one strap, for instance 22, includes a VELCRO fastener receiver, and the other strap, for example, 20, has the VELCRO fastener connector.

Of course, any type of fastener would be suitable for the present invention, such as a buckle and strap fastener, a tie fastener, a clasp fastener or the like; but it should be understood that the fastener as shown is preferred, in that it is convenient for fastening with the other hand of the user, without the necessity for two-handed fastening.

Figure 2:
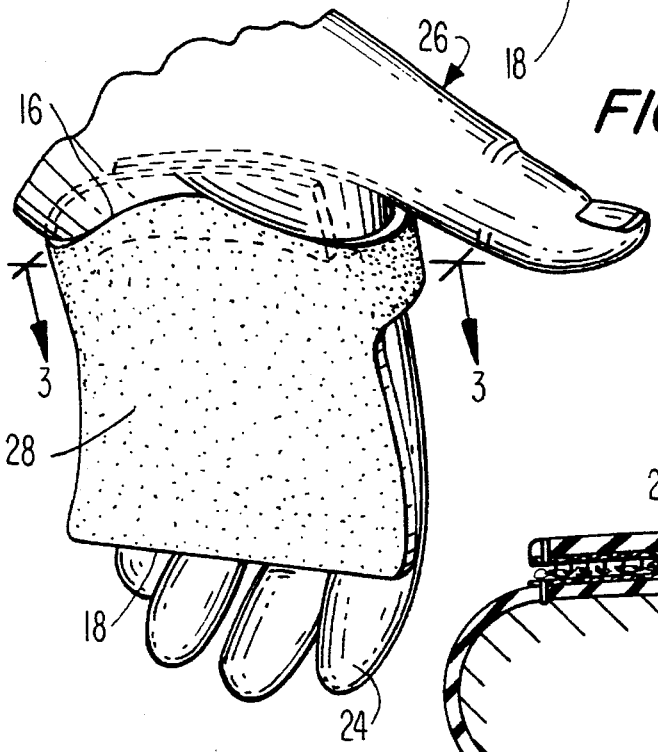
FIG. 2 is an isometric view of the invention, showing particularly the manner of fit of the exercise glove on the hand of the user.

As may be seen particularly in FIG. 2, curved end 16 fits comfortably at the upper part of the palm of the user's hand generally designated 26, and straight end 18 fits comfortably under the middle joints of the user's fingers 24.

Figure 3:
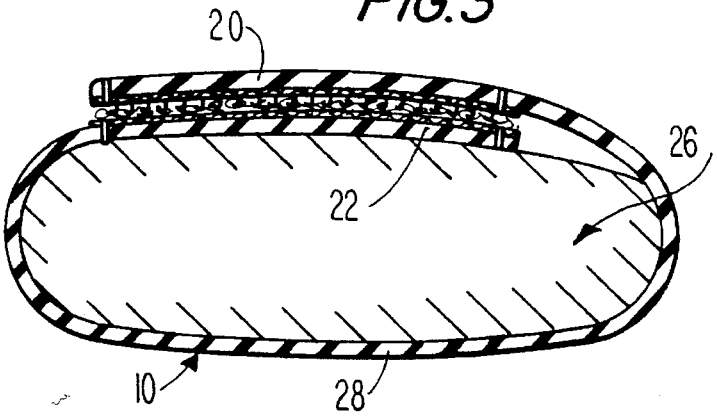
FIG. 3 is a sectional view of the invention taken along the line 3—3 of FIG. 2.
Figure 4:
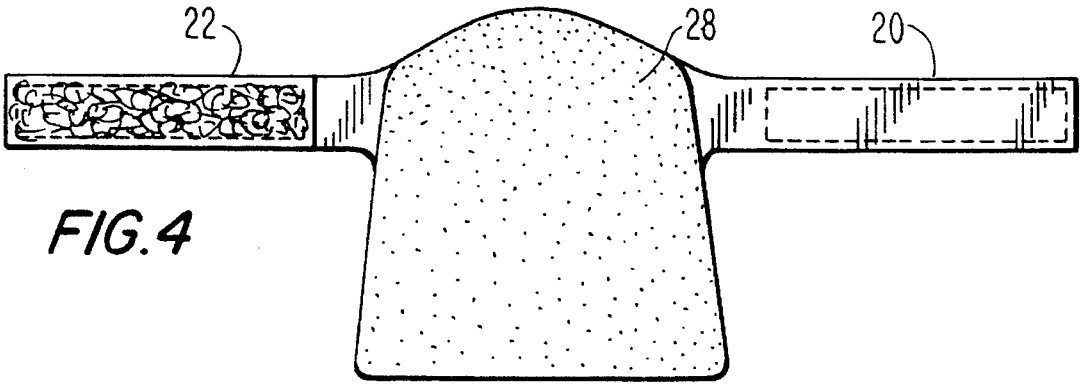
FIG. 4 is a bottom view, similar to that of FIG. 1, and showing particularly the stipples for good gripping on the outwardly facing surface thereof.

Referring to FIG. 3, the fastening of the straps at the back of hand 26 is shown. Furthermore, FIGS. 2, 3 and 4 represent the palm structure as defining a stippled bottom surface 28, for enabling better gripping, for instance of the weights being lifted, the bat being held, the chinning bar being held, etc.

Still further, an alternative embodiment of the present invention provides top surface 30 of palm structure 10 (FIG. 1) with a cushion fastened thereto or embedded therein, in order to cushion the impacts to be suffered by the palm structure during various exercises, without the hand of the user suffering the same.

The foregoing description is not intended to limit the structure or intended use of the present invention, but instead those limitations are only to be provided by the following claims:

What is claimed is:

1. An exercise glove for the hand of a user in exercises involving the gripping of a pole-like exercise device comprising a generally planar palm structure in approximately a rectangular form, the palm structure at one end defining a curved edge for conforming to the upper area of the palm of said hand, the palm structure at the other end defining a substantially straight edge for conforming to the underside of the fingers of said hand at the middle joints thereof, said curved edge constituting a first terminal end of said palm structure and said substantially straight edge constituting a second terminal end of said palm structure first and second straps extending outwardly from the sides, respectively, of the palm structure between said first and second terminal ends and proximate said curved edge, and said palm structure defining on its face, outwardly of said hand, a stippled surface.

2. The invention according to claim 1, wherein said palm structure includes on its face, in contact with said hand, a cushion for absorbing impacts during said exercises.

3. The invention according to claim 2, wherein said cushion is embedded within said palm structure.

4. The invention according to claim 2, wherein said cushion is attached to said palm structure on its face which is in contact with said hand.

* * * * *